United States Patent [19]

Lorett

[11] Patent Number: 4,629,396

[45] Date of Patent: Dec. 16, 1986

[54] ADJUSTABLE STATOR MECHANISM FOR HIGH PRESSURE RADIAL TURBINES AND THE LIKE

[75] Inventor: Jorge A. Lorett, Beaumaris, Australia

[73] Assignee: Borg-Warner Corporation, Chicago, Ill.

[21] Appl. No.: 661,546

[22] Filed: Oct. 17, 1984

[51] Int. Cl.[4] ..... B63H 1/06

[52] U.S. Cl. ..... 415/164; 415/165; 74/569

[58] Field of Search ..... 415/163, 164, 165, 150, 415/151; 74/63, 567, 569

[56] References Cited

U.S. PATENT DOCUMENTS

| | | | |
|---|---|---|---|
| 1,187,428 | 6/1916 | Homersham . | |
| 1,543,791 | 6/1925 | Pitter | 74/63 |
| 3,232,581 | 2/1966 | Swearingen | 415/164 |
| 3,243,159 | 3/1966 | Hefler et al. | 415/163 |
| 3,349,997 | 10/1967 | Beran et al. | 230/114 |
| 3,495,921 | 12/1967 | Swearingen | 415/163 |
| 3,736,070 | 5/1973 | Moskowitz et al. | 415/147 |
| 3,963,369 | 6/1976 | Balje | 415/148 |
| 4,300,869 | 11/1981 | Swearingen | 415/164 |
| 4,338,063 | 7/1982 | Nakanishi | 415/164 |
| 4,403,913 | 9/1983 | Fisker | 415/164 |
| 4,481,839 | 11/1984 | Zullo et al. | 74/569 |

FOREIGN PATENT DOCUMENTS

| | | | |
|---|---|---|---|
| 544499 | 2/1956 | Belgium | 415/164 |
| 3325756 | 9/1984 | Fed. Rep. of Germany . | |
| 611726 | 11/1948 | United Kingdom . | |
| 731822 | 6/1955 | United Kingdom | 415/164 |

*Primary Examiner*—Carlton R. Croyle
*Assistant Examiner*—Donald E. Stout
*Attorney, Agent, or Firm*—John W. Harbst

[57] ABSTRACT

Fluid handling apparatus such as a turbine, compressor, pump and the like in which stator vanes are adjustably positioned in the throat and means are provided to change the adjusted position of such vanes.

7 Claims, 5 Drawing Figures

FIG. 2
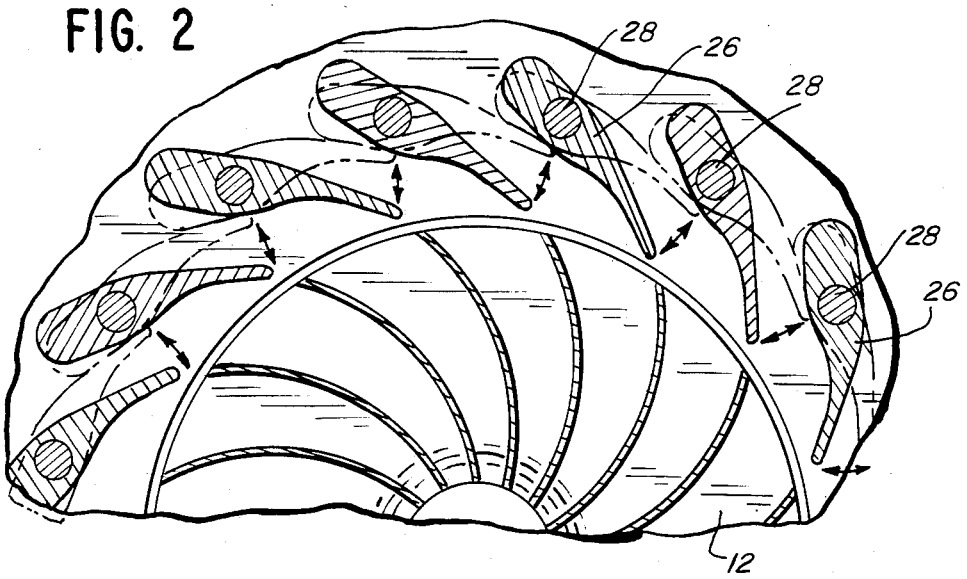
FIG. 4
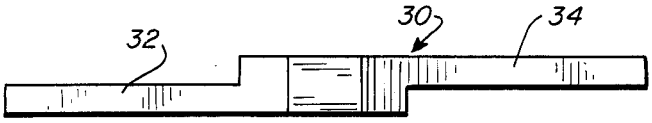
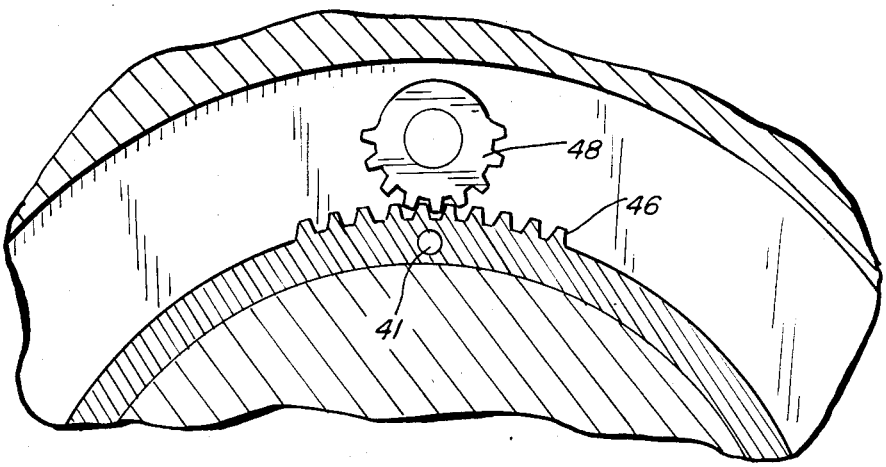
FIG. 5

ADJUSTABLE STATOR MECHANISM FOR HIGH PRESSURE RADIAL TURBINES AND THE LIKE

BACKGROUND OF THE INVENTION

1. Field of the Invention

This invention relates to high pressure radial turbines, compressors, pumps and the like and particularly to such devices having adjustable stator blades or vanes to vary the area of the throats defined between adjacent stator vanes. To operate at low specific flows, the dimensions of the stator throats must be adjusted very accurately if the desired peformance is to be achieved. Conventional arrangements comprising sliding pins or individual setting links connected to a control ring generally involve a certain amount of looseness on the vane setting, and can lead to jamming of the parts when and if high temperatures are involved.

2. Prior Art

Homersham, U.S. Pat. No. 1,187,428, relates to a centrifugal blower and the like in which the angle of each blade is adjusted, the blades each being formed with a tang fitting into a slot in a pin passing through a ring. A nut on each pin is tightened when the blade angle is set or reset to firmly hold the blade in position. The arrangement permits and requires each blade to be individually set.

Beran et al, U.S. Pat. No. 3,349,997, teaches an arrangement for adjusting diffuser blades in turbo-compressors. Each blade is attached by a pin to a rotatable ring. Rotation of the ring causes the pins to rotate which changes the blade angles.

Moskowitz et al, U.S. Pat. No. 3,736,070, teaches diffuser blades each of which is rotatable about a radial axis by movement of a ring surrounding the blades.

Balje, U.S. Pat. No. 3,963,369, teaches movable vanes in a diffuser, the position of which are adjusted by moving a ring in which the outer ends of the vanes are pivotably connected.

Swearingen, U.S. Pat. No. 3,495,921, teaches a variable nozzle turbine in which a plurality of nozzle blades are sandwiched between a piar of axially spaced concentrically-mounted rings. The blades are pivotably attached to the rings, one of the latter being rotatable while the other is fixed. Rotation of the one blade causes a change in angularity of all the blades.

SUMMARY OF THE INVENTION

According to the invention to be described herein, there is provided in a radial turbine, compressor, pump and the like adjustable stator blades or vanes defining a fluid flow path and a mechanism providing an essentially clearance free, self-locking stator vane adjusting arrangement, capable of coping with thermal transients without losing accuracy.

Broadly, the apparatus comprises a housing, a rotatable shaft, a fluid inlet and a fluid outlet in said housing, a stator through which said fluid flows in said housing; a fluid rotor connected to said shaft in said housing; a plurality of vanes in said stator to control the fluid flow therethrough, each vane being generally radially oriented and pivotable about an axis parallel to said shaft to change the radial direction thereof, and; means to pivot said vanes, said means comprising a plurality of circumferentially arranged vane control links, each link being connected to a vane and each link being pivotable about the pivotable axis of the respective vane and having a pair of spaced, radially directed cam followers, cam means engaged by said followers, and means to move said cam means relative to said followers to pivot said vanes and change the radial position thereof.

More specifically, the apparatus comprises a plurality of radially oriented vanes disposed in the throat of the turbine or the like, each vane being connected to or integral with and pivotable about a spindle to which circumferential positioned setting links are attached. Thus each setting link is pivotable about its respective spindle. Each setting link has a pair of radial depending follower arms, each arm of each link being in a different plane. A pair of rotatable cam rings, one the mirror image of the other, are provided and one arm of each setting link engages one of the cam rings. The cam rings are moved against each other, so as to adjust relatively to engage their respective link arms with the desired degree of clearance or interference and are then connected by multiple pins and also to a gear segment to ensure permanent retention of the desired clearances and positions. The gear segment connected to the cam rings is engaged by a gear mounted on a rotatable control spindle to provide a means for externally adjusting the vanes. By rotating the gear, the gear segment and the connected cam rings are rotated. The setting link follower arms engaging the cams are pivoted because of the cam-follower engagement and the vanes are rotated to thus adjust their radial orientations.

To prevent jamming of the mechanism as a result of temperature transients and differential thermal expansion in high temperature service, the cam rings are each saw-cut at one location along their periphery. This ensures that first order thermal expansion can be accommodated without change of the diameter of the rings other than that dictated by parts of the housing. Stresses due to change of curvature are quite low and do not cause distortion of the mechanism. Thus the vanes remain in their desired, adjusted positions.

In the foregoing description, the word turbine is used to describe not only turbines, but also compressors, pumps and the like.

BRIEF DESCRIPTION OF THE DRAWINGS

FIG. 2 is a cross-sectional view on a slightly reduced scale taken on line 2—2 of FIG. 1 showing at least one of the stator vanes and indicating in broken lines different positions thereof;

FIG. 4 is a top view on a slightly reduced scale of one of the setting links; and FIG. 5 is a cross-sectional view taken on a slightly reduced scale on line 5—5 of FIG. 1 illustrating the gear segment and the control gear used to adjust the settings of the vanes.

DETAILED DESCRIPTION OF THE PREFERRED EMBODIMENT

Figure 1:
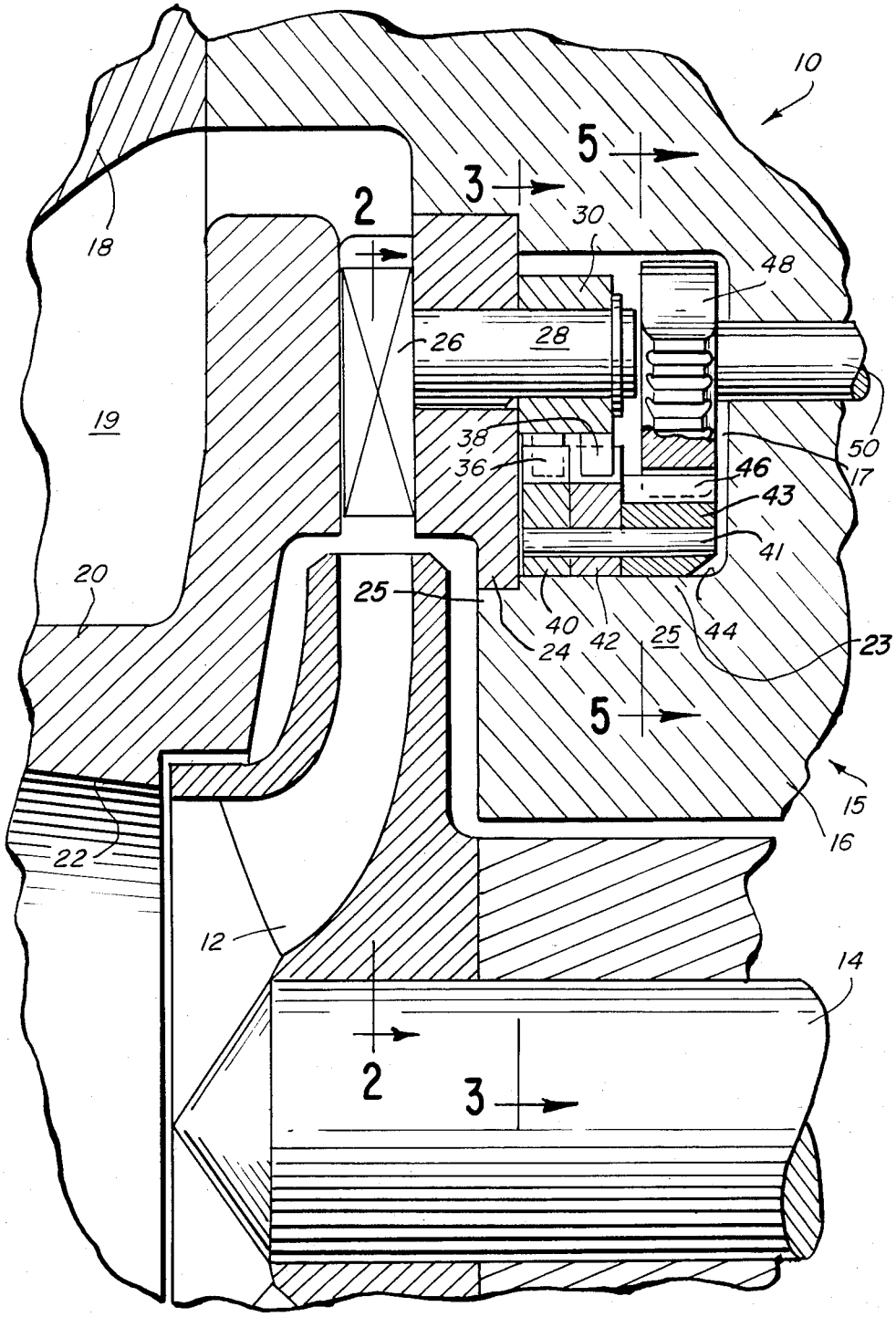
FIG. 1 is a cross-sectional view of a portion of a radial turbine illustrating the mechanism of this invention.

Refering to the drawings, in FIG. 1 there is illustrated a turbine 10 comprising a rotary turbine runner 12 connected to and supported by a shaft 14, a housing or casing 15 comprising a back cover 16, an inlet casing 18 defining an inlet 19 and a stator cover 20, the latter defining with the shaft 14 an outlet 22.

Figure 3:
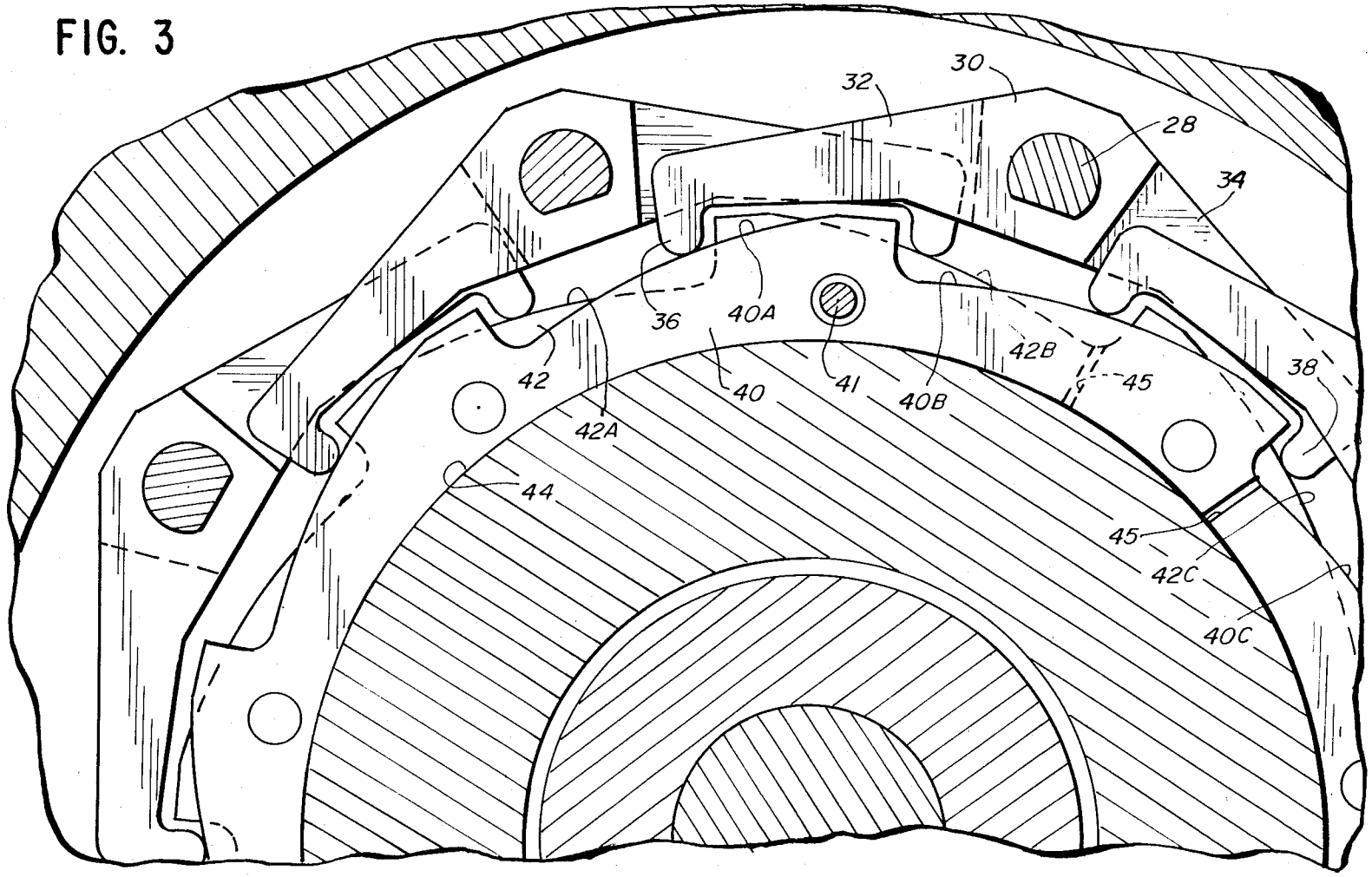
FIG. 3 is a cross-sectional view taken on line 3—3 of FIG. 1 showing the setting links and the cams of this invention.

The back cover 16 is provided with an annular cavity 17, the inner wall of which defines in part a first cylindrical boss 23 and a second cylindrical boss 25. A stator carrier ring 24 is fixedly supported on boss 25 and said carrier ring supporting a plurality of vanes 26 integral with or rigidly connected to vane spindles 28 journaled in the ring 24. By such construction, each spindle rotates about an axis which is maintained in a fixed spacial relationship relative to the shaft 14 and extends parallel thereto. A circumferentially oriented setting link 30 is rotatably supported by each spindle 28 and each link is provided with outwardly extending portions 32, 34 and radially directed cam followers 36, 38, (see FIG. 3). The portions 32 and 34 are axially offset from one another so as to be in different planes, as best illustrated in FIG. 4. A pair of ring shaped cams 40 and 42 are rotatably supported on boss 23, one cam being the mirror image of the other. The surface 44 of the boss 23 affords support and a bearing surface for the cam rings 40, 42. The cams 40, 42 are connected by means of one or more pins 41, only one of which is shown. Each cam is provided with a series of ramps 40A, 40B, etc. and 42A, 42B, etc., each ramp being engaged by a follower, either 36 or 38 of a setting link in a substantially clearance free, self-locking relationship. The particular relationship, i.e., the desired degree of clearance or interference, between the cams 40, 42 and the cam followers 36, 38, is determined before the cams 40, 42 are pinned together, which ensures accurate adjustment of the vanes 26 as is desired during operation of the turbine. Each cam ring has saw-cut radial slots 45 in order to accommodate thermal differential expansions at elevated temperature operation such that its setting is not disturbed by the elevated temperatures.

A ring 43 having an integral or attached gear segment 46 is also supported on boss 23 for limited rotation and is attached to the connected cam rings 40 and 42 by the pins 41, only one of which is shown. Thus by rotating the gear segment, the cam rings will also be rotated. By such construction, the cam rings simultaneously modulate the disposition of the diffuser vanes and thereafter maintain that disposition. Rotation of the ring 43 and cam rings 40 and 42 is limited to the arc defined by the gear segment 46. In order to rotate the gear segment and the cam rings, gear 48 is provided which meshes with the gear segment 46. The gear 48 is mounted on an axial shaft 50 journaled in and passing through the housing 15, so it can be rotated from a location outside the housing. Various means, such as a clamp and the like, not shown, can be provided so that the shaft 50 does not creep or lose its setting. Thus to change the setting of the stator vanes, the shaft 50 is rotated through an appropriate arc, the cam rings are rotated and the spindles 28 are rotated by the cam followers. The stator vanes connected to the spindles 28 then become adjusted for the desired performance.

While the above description refers to a turbine, the apparatus can be used as a pump or compressor in which case the shaft 14 is connected to a prime mover, not shown, and fluid is pumped from 22 through the impeller 12 and through 19. The vanes 26 act as diffuser vanes and direct the fluid discharge from the impeller to the outlet 19.

The appended claims are intended to cover all reasonable equivalents of the recited apparatus.

I claim:

1. A radial turbine, compressor or pump and the like comprising:

a housing;

a rotatable shaft;

a fluid inlet and a fluid outlet in said housing;

a stator through which said fluid flows in said housing;

a fluid rotor connected to said shaft in said housing;

a plurality of diffuser vanes in said stator whose disposition may be modulated to control the fluid flow through said stator, each diffuser vane being generally radially oriented and pivotable about an axis which is spacially maintained in a fixed relationship relative to the rotatable shaft and extends parallel thereto; and operative means providing a substantially clearance free, self-locking mechanism modulating the disposition of said diffuser vanes, said operative means comprising a plurality of circumferentially arranged vane control links, each link being connected to a diffuser vane and each link being pivotable about the fixed pivotable axis of the respective diffuser vane and having a pair of spaced, radially directed cam followers, cam means including a pair of cam rings having circumferential cam surfaces engaged by said followers, and means to move said cam means relative to said followers to pivot each diffuser vane about its fixed axis and change the radial position thereof.

2. Apparatus as recited in claim 1, wherein each cam ring is the mirror image of the other.

3. Apparatus as recited in claim 2, in which one cam follower of each control link engages a cam surface of one cam ring and the other cam follower of each control link engages the corresponding cam surface of the other cam ring.

4. Apparatus as recited in claim 3, in which said cam rings are connected so as to pivot in unison.

5. Apparatus as recited in claim 4, further comprising a gear segment connected to said cam rings and a gear meshing with said gear segment, and in which rotation of said gear causes rotative movement of said cam rings and thus pivoting of said vanes.

6. Apparatus as recited in claim 5 in which all vanes are caused to pivot when said cam rings are rotated.

7. Apparatus as recited in claim 6 in which each cam ring is radially slotted to withstand thermal differential expansions at high temperatures.

* * * * *